US011220370B2

(12) United States Patent
Purkey

(10) Patent No.: US 11,220,370 B2
(45) Date of Patent: Jan. 11, 2022

(54) FOOD CONTAINER

(71) Applicant: Sargento Foods Inc., Plymouth, WI (US)

(72) Inventor: Todd Purkey, Elkhart Lake, WI (US)

(73) Assignee: Sargento Foods Inc., Plymouth, WI (US)

( * ) Notice: Subject to any disclaimer, the term of this patent is extended or adjusted under 35 U.S.C. 154(b) by 27 days.

(21) Appl. No.: 16/023,093

(22) Filed: Jun. 29, 2018

(65) Prior Publication Data

US 2020/0002055 A1 Jan. 2, 2020

(51) Int. Cl.

| | |
|---|---|
| ***B65D 21/02*** | (2006.01) |
| ***B65D 77/20*** | (2006.01) |
| ***B65D 53/08*** | (2006.01) |
| ***B65D 6/00*** | (2006.01) |

(52) U.S. Cl.

CPC ..... *B65D 21/0209* (2013.01); *B65D 11/10* (2013.01); *B65D 53/08* (2013.01); *B65D 77/2024* (2013.01)

(58) Field of Classification Search

CPC ..... B65D 21/0209; B65D 11/10; B65D 77/2024; B65D 53/08; B65D 5/06; B65D 5/5233; B65D 5/5253; B65D 5/54; B65D 5/6623

USPC ..... 220/23.8

See application file for complete search history.

(56) References Cited

U.S. PATENT DOCUMENTS

| | | | | |
|---|---|---|---|---|
| 5,901,848 | A * | 5/1999 | Gorlich | B65D 81/245 206/439 |
| 8,800,768 | B2 | 8/2014 | Corbat et al. | |
| 2012/0097563 | A1* | 4/2012 | Packard | A61B 17/3215 206/372 |
| 2017/0320656 | A1* | 11/2017 | Oskarsson | B65D 1/22 |

FOREIGN PATENT DOCUMENTS

| | | |
|---|---|---|
| EP | 2975078 | 1/2016 |

* cited by examiner

*Primary Examiner* — Anthony D Stashick
*Assistant Examiner* — James M Van Buskirk
(74) *Attorney, Agent, or Firm* — Boyle Fredrickson, SC

(57) ABSTRACT

A food container includes a body having a first and second receptacle. A first food product is contained in the first receptacle. A second food product is contained in the second receptacle. A lid includes two portions coupable to the body, a first portion configured to enclose the first receptacle and a second portion configured to enclose the second receptacle. Each portion has a permeability, and the first portion has a permeability different than the second portion.

24 Claims, 8 Drawing Sheets

FOOD CONTAINER

BACKGROUND

The present disclosure relates to a product container for product packaging, and more specifically to a food container able to support multiple food product packaging.

SUMMARY

In one construction, the disclosure provides a food container including a body having a first and second receptacle. A first food product is contained in the first receptacle. A second food product is contained in the second receptacle. A lid includes two portions coupable to the body, a first portion configured to enclose the first receptacle and a second portion configured to enclose the second receptacle. Each portion has a permeability, and the first portion has a permeability different than the second portion.

In another construction, the disclosure provides a food container including a body having at least two product receptacles containing at least two different food products and a hinge. A lid includes at least two portions coupable to the body, the at least two portions configured to enclose the at least two respective receptacles. Each portion has a permeability. At least one separator member extends from the body. One of the portions has a permeability higher than the others of the portions. One of the receptacles is movable into a stacked relationship relative to one of the other of the receptacles by way of the hinge. The at least one separator member is configured to separate the stacked receptacles for facilitating air flow.

In another construction, the disclosure provides a food container including a first receptacle containing a first food product. A first lid encloses the first receptacle and has a first permeability. The food container including a second receptacle containing a second food product. A second lid encloses the second receptacle and has a second permeability. The food container further includes a separator. The first permeability is different than the second permeability. The receptacles are stacked so that the first and second lids are adjacent. The separator is positioned between the stacked receptacles to facilitate air flow.

Other aspects of the disclosure will become apparent by consideration of the detailed description and accompanying drawings.

DETAILED DESCRIPTION

Before any constructions of the disclosure are explained in detail, it is to be understood that the disclosure is not limited in its application to the details of construction and the arrangement of components set forth in the following description or illustrated in the following drawings. The disclosure is capable of other constructions and of being practiced or of being carried out in various ways.

FIGS. 1-8 illustrate a body 10 convertible into a food container 14 in accordance with the present invention. The food container 14 includes the body 10 and a lid 18. The food container 14 may be configured to support multiple food product types and prolong product life until ready for consumer use.

Figure 1:
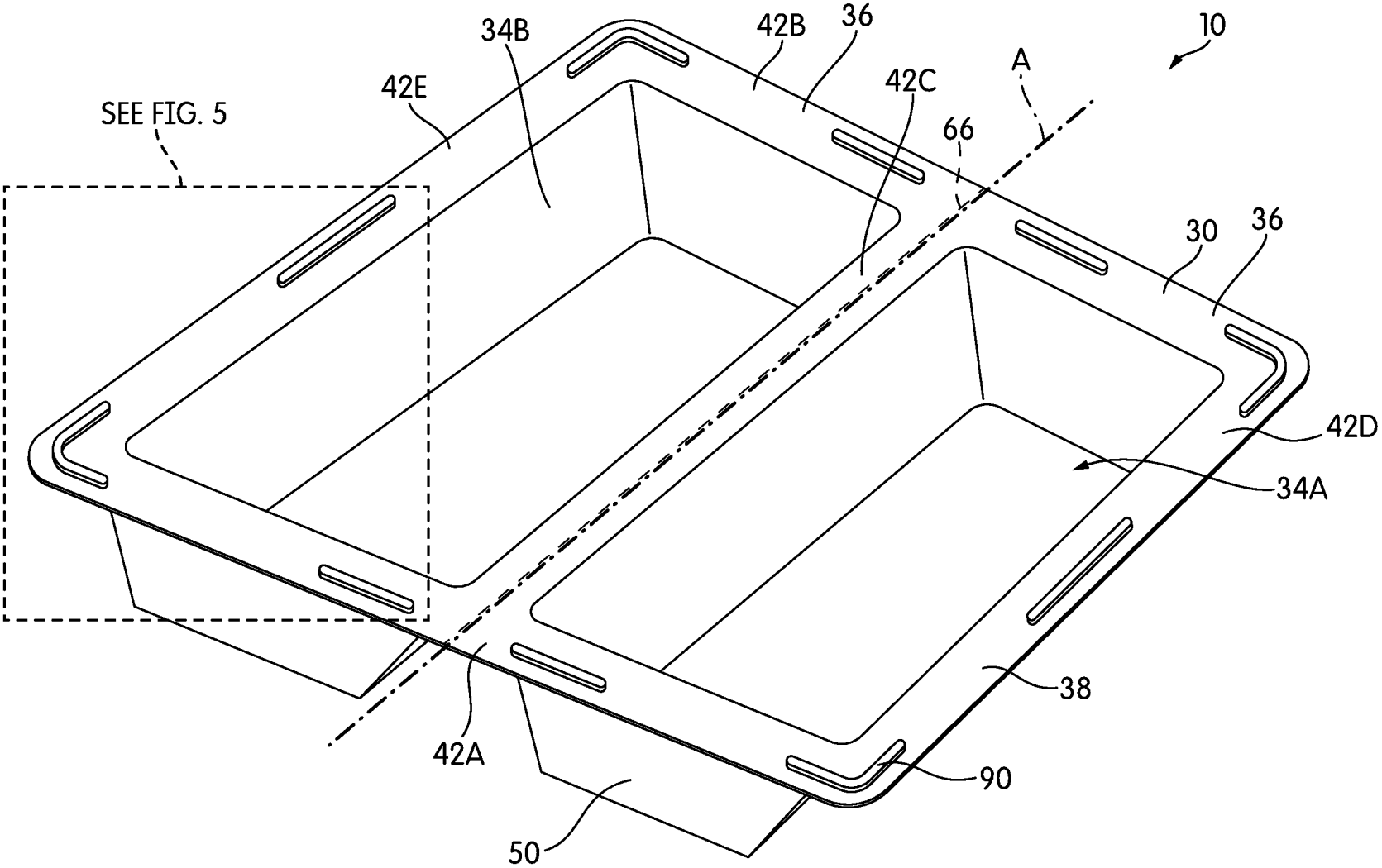
FIG. 1 is a perspective view of a body including two cavities.

With reference to FIG. 1, the body 10 includes a rim 30 and a plurality of cavities or product receptacles 34 such as the two receptacles 34A, 34B. More than two receptacles 34 can be utilized depending upon the product packaging needs. In the illustrated construction, the body 10 is formed from a piece of plastic such as polyethylene terephthalate (PET), polypropylene (PP), etc. However, other types of materials, such as cardboard, card stock, other paper materials, organic pulp, fibers, fabrics, polymers, resins, metals, composites, and the like, or any mixture thereof, may be employed.

With continued reference to FIG. 1, the rim 30 includes a first surface 38 extending around the receptacles 34A, 34B. Each receptacle 34A, 34B has a periphery 36 formed by at least a portion of the first surface 38. The rim 30 is generally planar and may have the same or varying thickness in generally the same plane; however, in other constructions, the rim 30 may be bent or curved. The illustrated first surface 38 includes edges 42A-E defining the rim 30. At least some of the edges 42A-E define each periphery 36. The rim 30 further defines a longitudinal axis A extending through a first edge 42A and a second edge 42B. In the illustrated construction, the rim 30 includes generally straight edges 42A-E. In other constructions, the rim 30 may include other types of edges 42A-E including curved, concave, convex, pointed, and the like. In the illustrated construction, the body 10 has two edges 42A, 42B extending substantially perpendicular to the longitudinal axis A and three edges 42C-E extending substantially parallel to the longitudinal axis A. In other constructions, the rim 30 may include at least three edges 42.

Each receptacle 34A, 34B is defined by a second surface 50 extending from the first surface 38. The receptacles 34A, 34B are positioned within the edges 42A-E of the rim 30. In other constructions, the body 10 may include more than two receptacles 34 formed by the second surface 50. Furthermore, the second surface 50 of any of the receptacles 34A, 34B may be configured to define an indicia region (not shown) in which logos, images, brands, text, marks, and other indicia can be displayed.

The receptacles 34A, 34B are separated by any one of the edges 42A-E of the rim 30. For example, the illustrated first and second receptacles 34A, 34B are separated by a third edge 42C extending along the longitudinal axis A. The second surface 50 defines sides that are couplable to the rim 30 (i.e., to the edges 42A-E) to form the receptacles 34A, 34B.

With continued reference to FIG. 1, the illustrated body 10 includes a hinge 66. The hinge 66 is formed by perforations, segmented parts, and the like. The hinge 66 is between the first and second receptacles 34A, 34B. Specifically, the illustrated third edge 42C includes the hinge 66 with a first set of perforations extending along the longitudinal axis A from the first edge 42A to the second edge 42B. In other constructions, the body 10 may include no perforations or two or more sets of perforations positioned on any of the edges 42A-E. The hinge 66 may be configured to facilitate bending or folding of the body 10. The hinge 66 may facilitate separation of one of the receptacles 34A, 34B from another one of the receptacles 34A, 34B.

Figure 3:
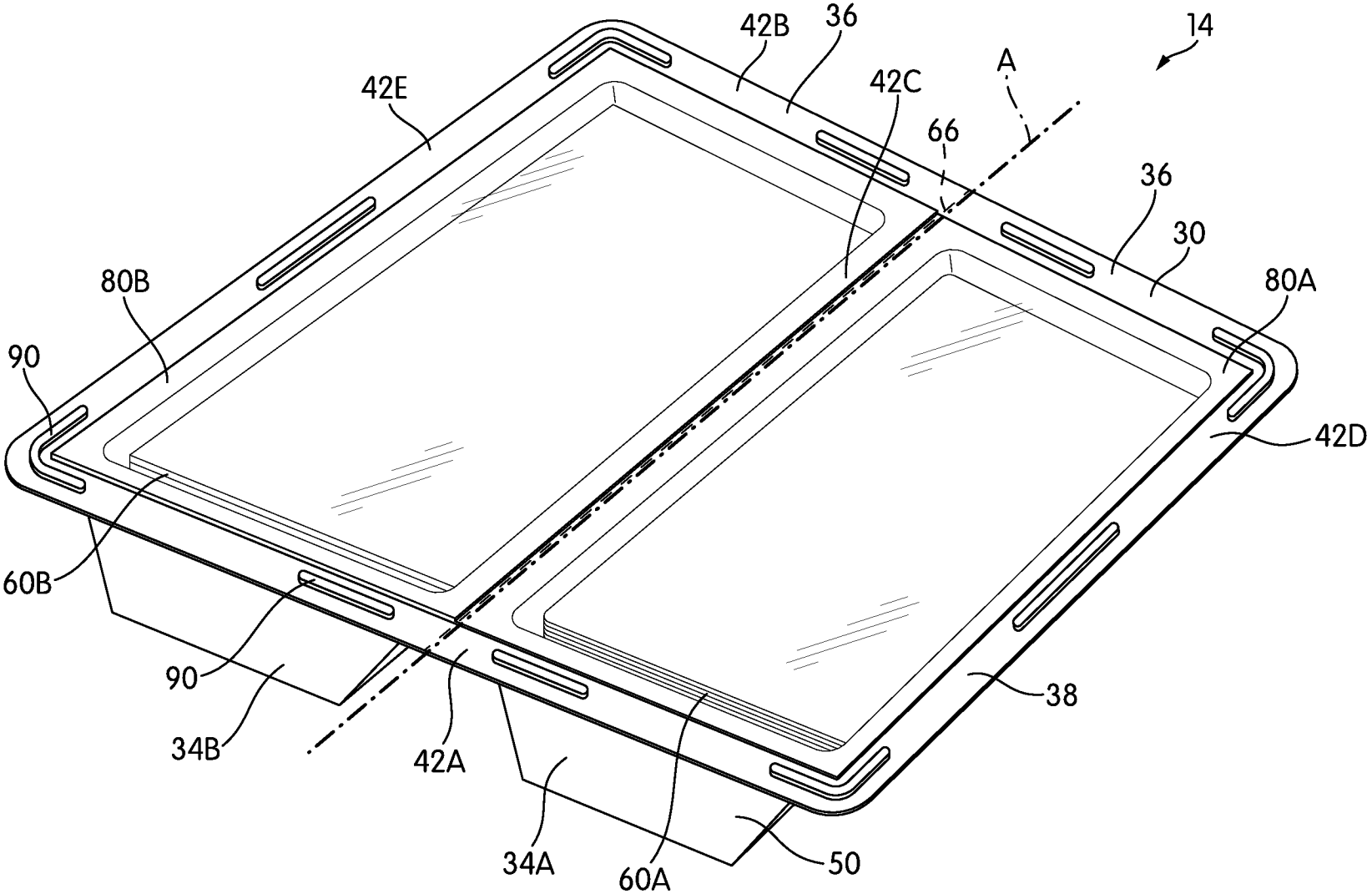
FIG. 3 is a perspective view of a product container including the body of FIG. 1 and the lid of FIG. 2.

With reference to FIGS. 1 and 3, the receptacles 34A, 34B are configured to form pockets. In the illustrated construction, the receptacles 34A, 34B have a shallow, generally rectangular shape; however, in other constructions, the receptacles 34A, 34B may form any three-dimensional shape including cylindrical, spherical, and the like. The receptacles 34A, 34B are configured to receive and contain different food products 60A, 60B (FIG. 3). For example, the food product 60A, 60B includes packaged food, such as cheese, meats, crackers or nuts. For example, as shown in FIG. 3, the first receptacle 34A receives a stack of cheese 60A and the second receptacle 34B receives a stack of crackers 60B. A depth of the receptacles 34A, 34B may be predetermined based on a size and quantity of the food product 60A, 60B or group of food product 60A, 60B being contained within the receptacles 34A, 34B. As such, each receptacle 34A, 34B is configured to receive its respective food product 60A, 60B. Furthermore, the food container 14 may include more than two receptacles 34A, 34B in which a third receptacle may receive a utensil (e.g., fork, spoon, etc.).

The illustrated body 10 is manufactured using thermoforming; however, any other suitable manufacturing process may be used to form the body 10. Specifically, the body 10 including the rim 30 and the receptacles 34A, 34B may be formed during thermoforming from a piece of material. In addition, the body 10 may be thermoformed into an open configuration (FIG. 1). The hinge 66 may also be formed using thermoforming and a method for perforating the material or any other suitable manufacturing process or added after manufacture of the body 10.

Figure 2:
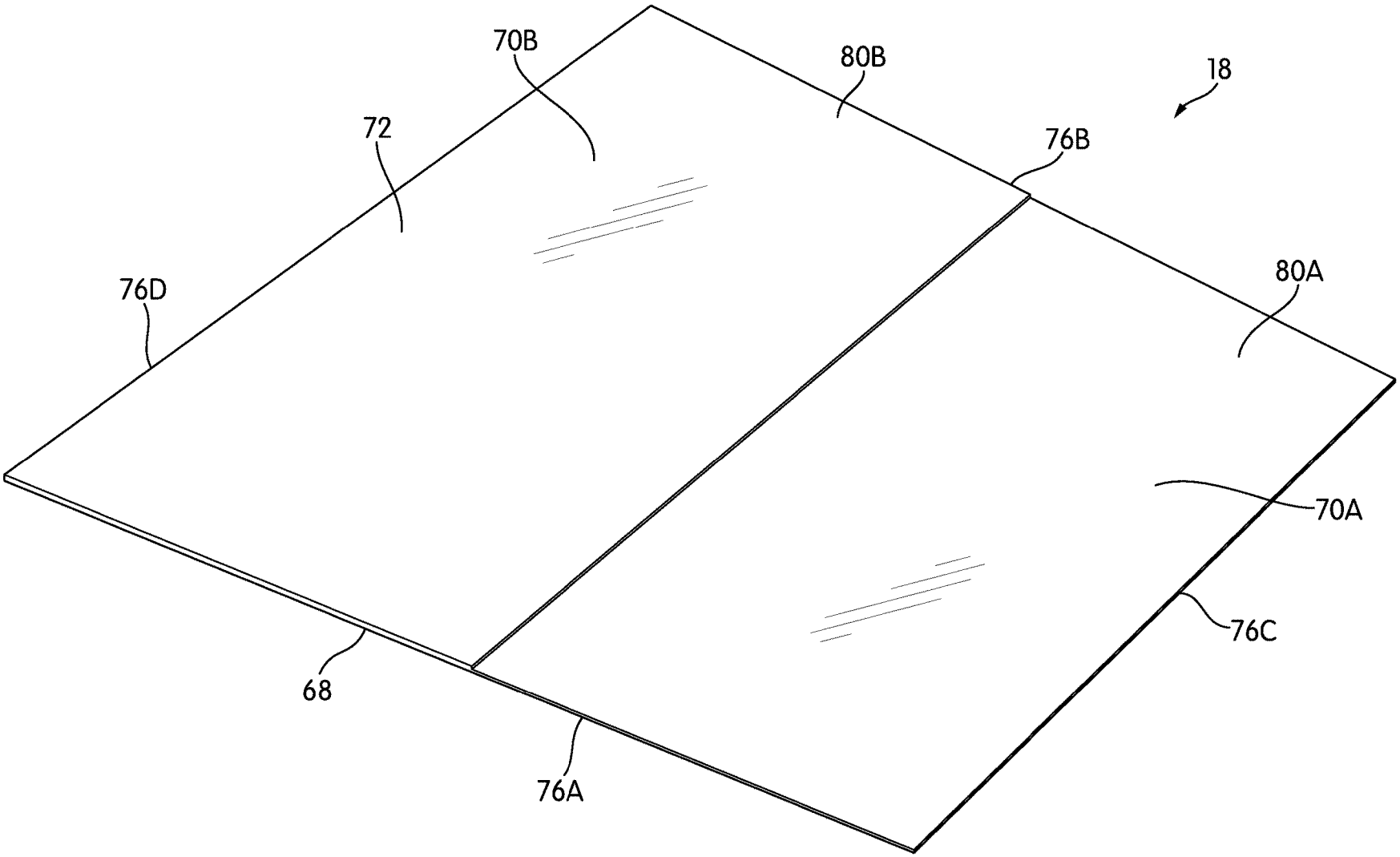
FIG. 2 is a perspective view of a lid.

With reference to FIG. 2, the lid 18 in one embodiment includes a first side 68 and a second side 72. In the illustrated construction, the lid 18 is formed from a piece of plastic such as PET or PE plastics. However, other types of materials, such as organic pulp, synthetic fibers, fabrics, polymers, and the like, or any mixture thereof, may be employed. The lid 18 may be formed from a portion that is unrolled from a roll of material or cylindrical body (not shown). Specifically, during assembly, the cylindrical body is unrolled to a predetermined length and cut to form the lid 18.

The lid 18 includes sides 70A-B and edges 76A-D defining the first and second sides 68, 72. The illustrated lid 18 includes straight edges 76A-D; however, in other constructions, the edges 76A-D may be curved, pointed, or the like. Dimensions of the edges 76A-D of the lid 18 correspond to dimensions of the body 10. Furthermore, the lid 18 may include an indicia region defined by a surface on the second side 72 in which logos, images, brands, text, marks, and other indicia can be displayed. The illustrated lid 18 is flexible such that the lid 18 is not configured to add rigidity to the body 10.

With reference to FIGS. 2 and 3, the first side 68 includes a surface couplable to the rim 30. Specifically, an outer portion of the first side 68 is attached to the periphery 36 of each receptacle 34A, 34B. Also, in the illustrated construction, a center portion of the first side 68 is configured to attach to the third edge 42C. The illustrated lid 18 is attached using heat sealing such that the lid 18 is sealingly coupled to the rim 30; however, any other suitable manufacturing process may be used to attach the lid 18 to the rim 30. The lid 18 is sealed to the body 10 near the periphery 36 of each receptacle 34A, 34B. Furthermore, thermal adhesives may be applied to specific areas of the body 10 and/or the lid 18 for coupling the lid 18 and the body 10 together.

The lid 18 is attached such that the lid 18 forms a sealing layer or film on the body 10. In other words, the lid 18 is configured to form a barrier between the food product 60A, 60B and the environment when attached to the body 10. The lid 18 is attached to the periphery 36 of each receptacle 34A, 34B such that the lid 18 is configured to enclose each of the receptacles 34A, 34B. As such, the rim 30 (i.e., the peripheries 36) is configured to form a seal area for attaching the lid 18 to the body 10. Furthermore, the lid 18 may be peelable to expose the food product 60A, 60B in each receptacle 34A, 34B. In other words, a consumer may peel back the lid 18 from the body 10 to access the food products 60A, 60B positioned within the receptacles 34A, 34B when being consumed.

With continued reference to FIG. 2, the lid 18 includes a plurality of portions 80A, 80B. The illustrated lid includes two pieces with one piece containing the first portion 80A and a separate second piece containing the second portion 80B. In this construction, the portion 80A may be configured as a first lid and the second portion 80B may be configured as a second lid. The number of portions 80A, 80B may be dependent on the number of receptacles 34A, 34B. For example, in the illustrated construction, the lid 18 includes first and second portions 80A, 80B corresponding to the first and second receptacles 34A, 34B; however, in other constructions, the lid 18 may include any number of portions 80 (e.g., one, three, four, etc.), in which the number of portions 80 may not be dependent on the number of receptacles 34. For example, the lid 18 may have three portions 80 and the body 10 may include two receptacles 34.

Each portion 80A, 80B has a permeability. The permeability may be defined as the measure of transmission of fluid (i.e., transmission rate) through the portions 80A, 80B of the lid 18. More specifically, each portion 80A, 80B has the permeability such that fluid (e.g., gas, air, moisture) may be at least partially inhibited from passing through the lid 18. In the illustrated construction, at least one of the portions 80A, 80B has a permeability that is different than the other of the portions 80A, 80B. For example, in the illustrated construction, the permeability of the second portion 80B has a lower permeability (i.e., lower required transmission rate) such that the amount of fluid that may pass through the second portion 80B into the second receptacle 34B is reduced or eliminated. Alternatively, the permeability of the first portion 80A is higher (i.e., higher required transmission rate) than the permeability of the second portion 80B such that the amount of fluid that may pass through the first portion 80A is higher than the amount of fluid able to pass through the second portion 80B. As such, the portion 80A has a first permeability and the portion 80B has a second permeability that is different than the first permeability.

The permeability of each portion 80A, 80B is dependent on the type of food products 60A, 60B received in each receptacle 34A, 34B. For example, the illustrated food product 60A is cheese (e.g., Swiss cheese) which requires a higher transmission rate (i.e., an increase in gas transmission through the lid 18) due to respiration than the food product 50B, which may not require respiration, such that the portion 80A requires a higher permeability. Each portion 80A, 80B is configured to enclose each receptacle 34A, 34B for ensuring the required permeability for each food product 60A, 60B received within each receptacle 34A, 34B. The food products 60A, 60B are enclosed by the portions 80A, 80B having the different permeability due to the required respiration rates of each of the food products 60A, 60B. As such, the permeability of each portion 80A, 80B is determined based on the type of food products 60A, 60B that will be placed within the respective receptacle 34A, 34B.

In one example, the food product 60A is Swiss cheese and the food product 60B is crackers. To achieve the required respiration rate of the Swiss cheese, the first portion 80A has a carbon dioxide transmission rate of about 51cc per 100 $in^2$ per 24 hours, and an oxygen ($O_2$) transmission rate of about 8cc per 100 $in^2$ per 24 hours or less with a water vapor transmission rate (WVTR) of about 1 gram per 100 $in^2$ per 24 hours or less (at atmospheric pressure of about 14.7 psi and atmospheric temperature of about 59° F.). To achieve the required respiration rate of the crackers, which is oxygen and moisture sensitive, the second portion 80B has a carbon dioxide transmission rate of about 15cc per 100 $in^2$ per 24 hours, and an $O_2$ transmission rate of about 5cc per 100 $in^2$per 24 hours or less with a WVTR of about 1 gram per 100 $in^2$ per 24 hours or less (at atmospheric pressure of about 14.7 psi and atmospheric temperature of about 59° F.). The transmission rate of the first portion 80A and the transmission rate of the second portion 80B is different due to the required different respiration rates.

The lid 18 may be manufactured to include two or more separate pieces such that each portion 80A, 80B may be separately manufactured and attached to the rim 30 (i.e., the periphery 36 of each receptacle 34).

In a first embodiment of the food container 14, the body 10 is reconfigurable into the food container 14 in steps as shown in FIGS. 1-3. As shown in FIG. 1, the body 10 is formed into the open configuration including the plurality of receptacles 34A, 34B and the rim 30 surrounding the receptacles 34A, 34B. As shown in FIG. 2, the lid 18 is formed to include the plurality of portions 80A, 80B having the different permeability. The products 60A, 60B are loaded into the respective receptacles 34A, 34B, and the lid 18 is coupled to the body 10. The seal areas of the rim 30 are sized such that each portion 80A, 80B is effectively coupled to the body 10 for enclosing each receptacle 34A, 34B suitably. As such, the food container 14 is formed from the body 10 and the lid 18 once the food products 60A, 60B have been loaded into the respective receptacles 34A, 34B. The food container 14 may be configured as multi product packaging in which the different products 60A, 60B are supported by the food container 14 having the different permeable portions 80A, 80B of the lid 18. Furthermore, the food container 14 may be used (i.e., shipped, sold, etc.) as open packaging (FIG. 3), clamshell packaging (FIG. 4), or as other types of packaging.

Figure 4:
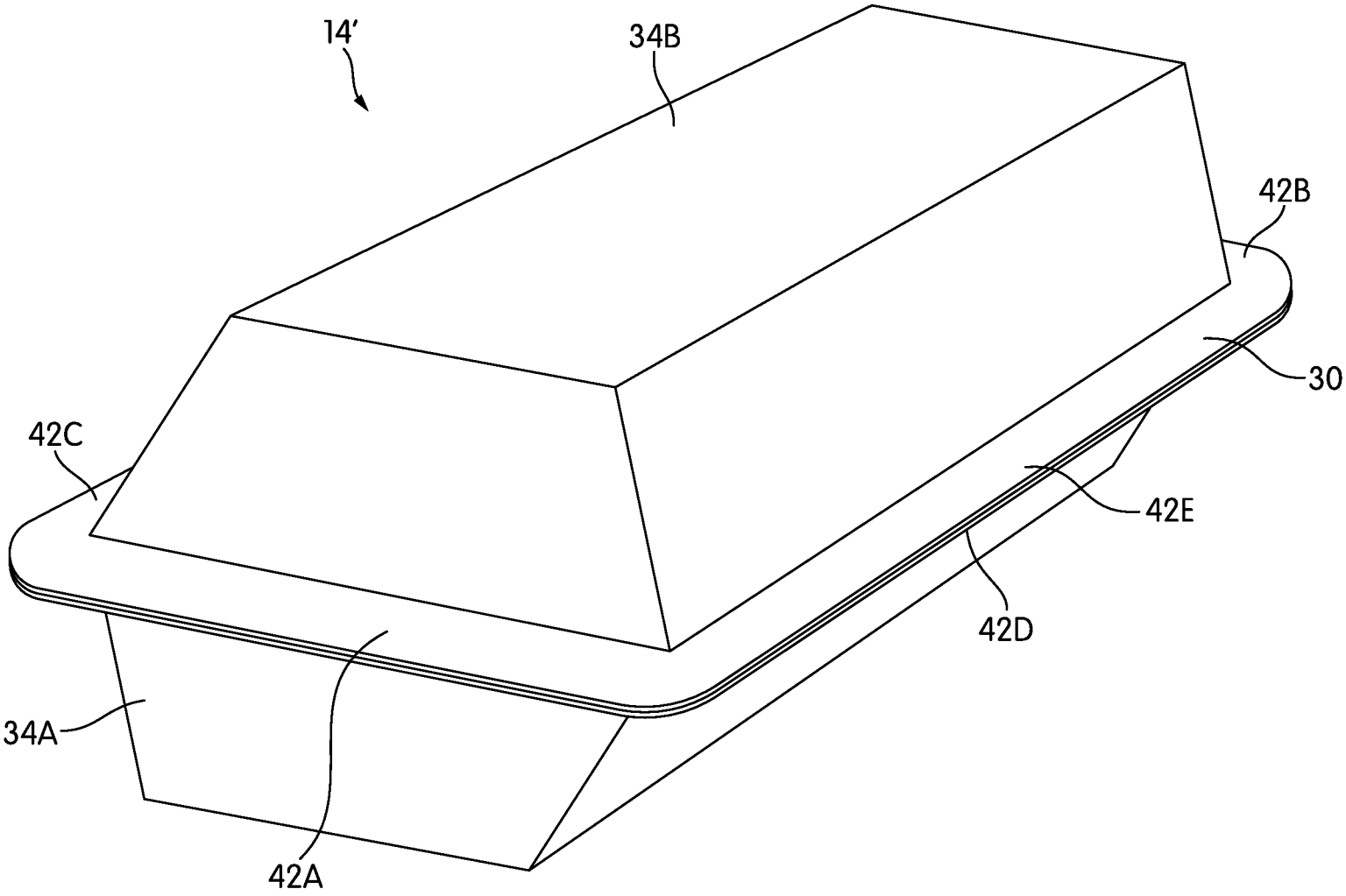
FIG. 4 is a perspective view of a clamshell package.
Figure 5:
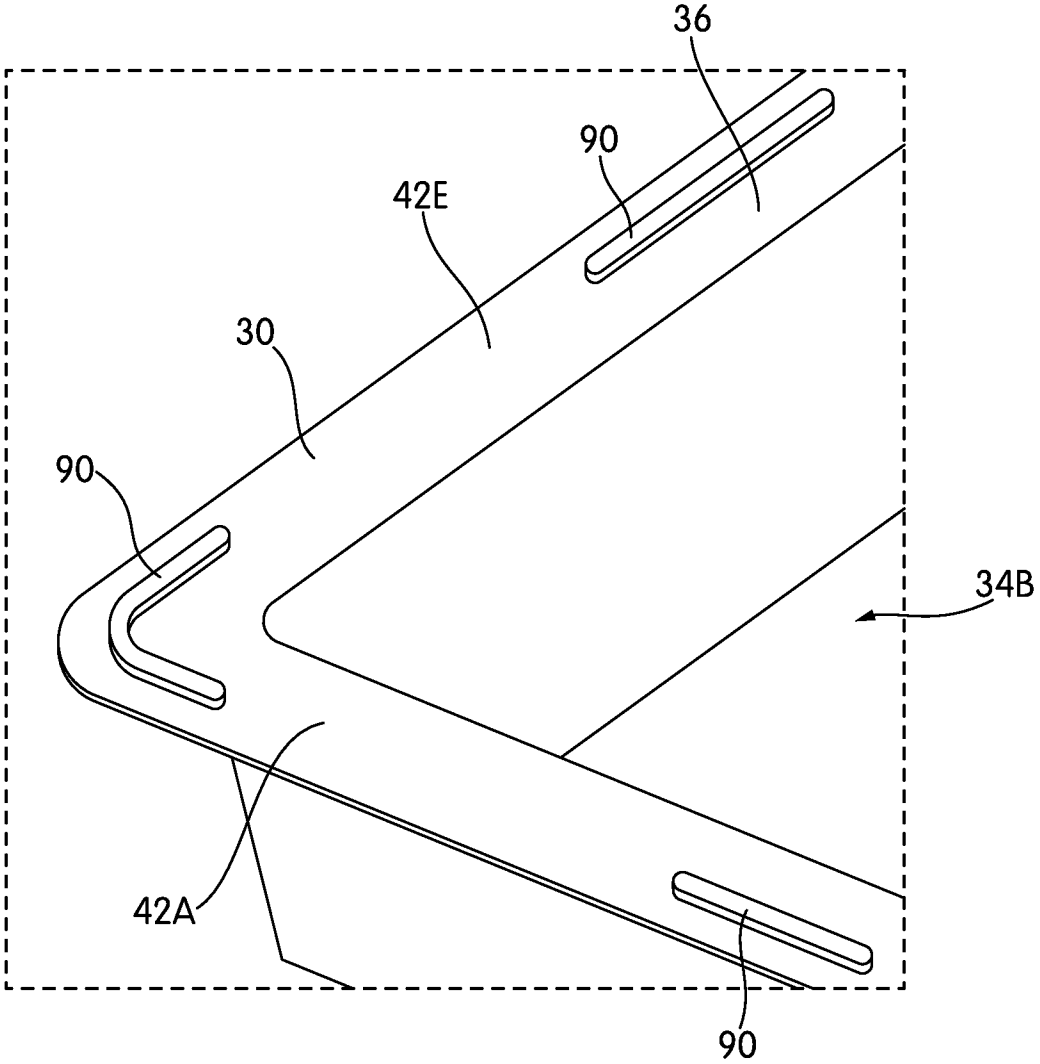
FIG. 5 is a partial, perspective view of rail members.

In a second embodiment with particular reference to FIG. 4, the illustrated hinge 66 is located on the edge 42C. As such, at least one of the receptacles 34A, 34B is movably coupled to the body 10 such as by rotation, pivoting, bending, and the like. For example, in the illustrated construction, one of the receptacles 34A, 34B of the food container 14' is movable relative to the other of the receptacles 34A, 34B about the longitudinal axis A using the hinge 66. As shown in FIG. 4, the receptacle 34A containing the food product 60A is positioned below the receptacle 34B containing the food product 34B once the food container 14 is configured into a clamshell or stacked orientation. In other words, the receptacle 34A is movable to a position stacked upon the other receptacle 34B such that the receptacles 34A, 34B are movable into a stacked relationship. Furthermore, the third edge 42C shared by the receptacles 34A, 34B is split substantially equally along the hinge 66 extending along the longitudinal axis A. As such, the rim 30 surrounding each receptacle 34A, 34B forms substantially equal seal areas. In other constructions, the seal area defined by any one of the edges 42A-E may be split by way of the hinge such that the rim 30 forms differently-sized seal areas. In other constructions the hinge 66 may not be utilized.

The body 10 is reconfigurable into the food container 14' in steps as shown in FIGS. 1-4. Specifically, the body 10 may be configured into the clamshell packaging orientation by rotational movement about the hinge 66. Similar to the configuration of the body 10 into the food container 14 of FIG. 3, the steps may further include, after the lid 18 is coupled to the body 10, rotating at least one of the receptacles 34A, 34B about the hinge 66 to position the receptacle 34A, 34B below or above another one of the receptacles 34A, 34B. As such the food container 14' of FIG. 4 is configured as the clamshell packaging when one of the receptacles 34A, 34B is moved into a stacked relationship with the other of the receptacles 34A, 34B by way of the hinge 66. In this configuration, the portions 80A, 80B of the lid 18 bend with the bending of the rim 30 (i.e., the edge 42C) along the hinge. The receptacles 34A, 34B are stacked so that the portions 80A, 80B are adjacent each other along a vertical direction in the clamshell packaging.

With reference to FIGS. 1 and 5-8, the illustrated food container 14, 14', 14" may further include a separator member such as protrusions or rail members 90 that act as a receptacle separator to create air flow and an air gap. The rail members 90 are formed on the body 10 and extend from the body 10. In other constructions, the separator member may be separate from the body 10.

Preferably, the rail members 90 extend substantially perpendicular from the rim 30. The rail members 90 preferably have a generally rectangular shape; however, in other constructions, the rail members 90 may form any three-dimensional shape including cylindrical, spherical, and the like. The rail members 90 are preferably positioned on each of the edges 42A-E. In the illustrated construction, the body 10 includes ten rail members 90 including five rail members 90 surrounding the first receptacle 34A and five rail members 90 surrounding the second receptacle 34B. In other constructions, the body 10 may include any number of rail members 90 positioned on any section of the edges 42A-E or one continuous rail 90. Furthermore, the body 10 may include no rail members 90 positioned on some of the edges 42A-E. For example, the third edge 42C does not include the rail member 90. Furthermore, in other constructions, the body 10 may not include any rail members 90.

Figure 6:
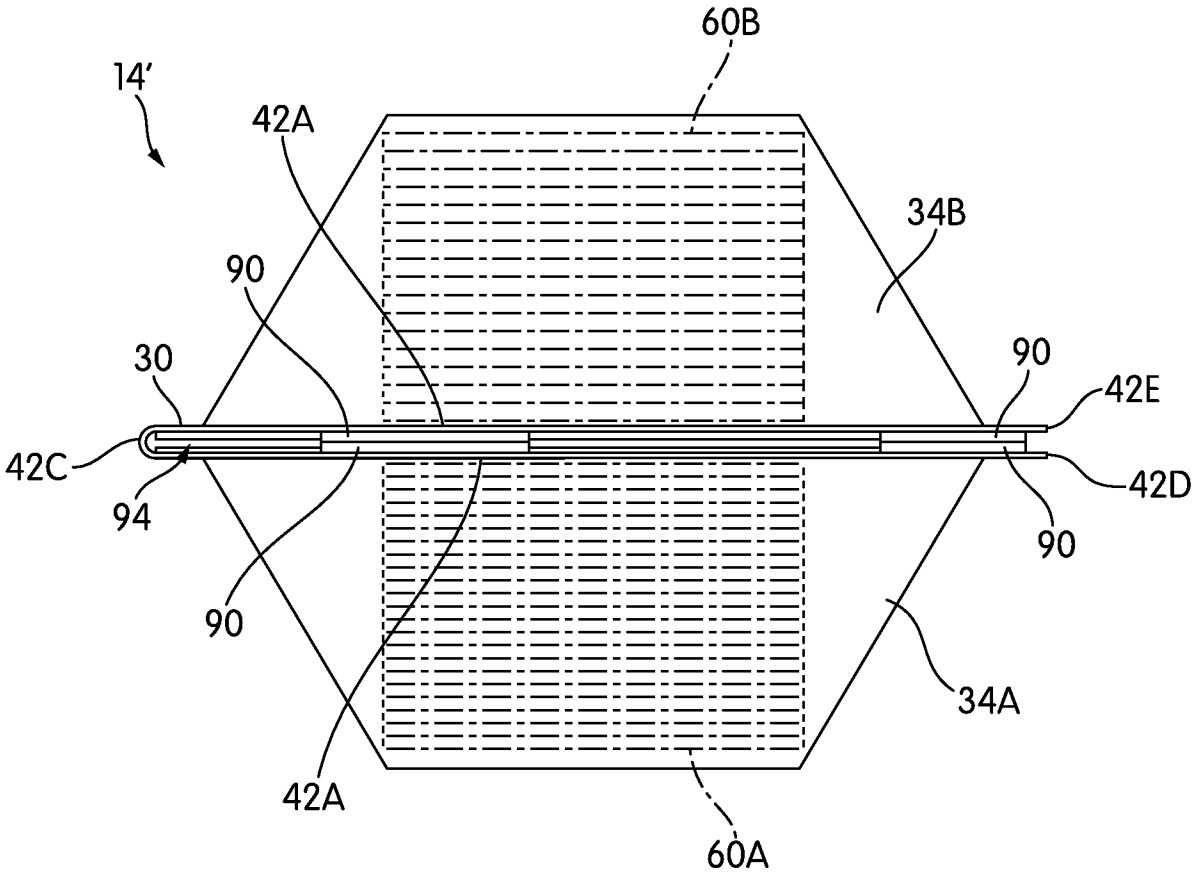
FIG. 6 is a front view of the clamshell package including the rail members of FIG. 5.
Figure 7:
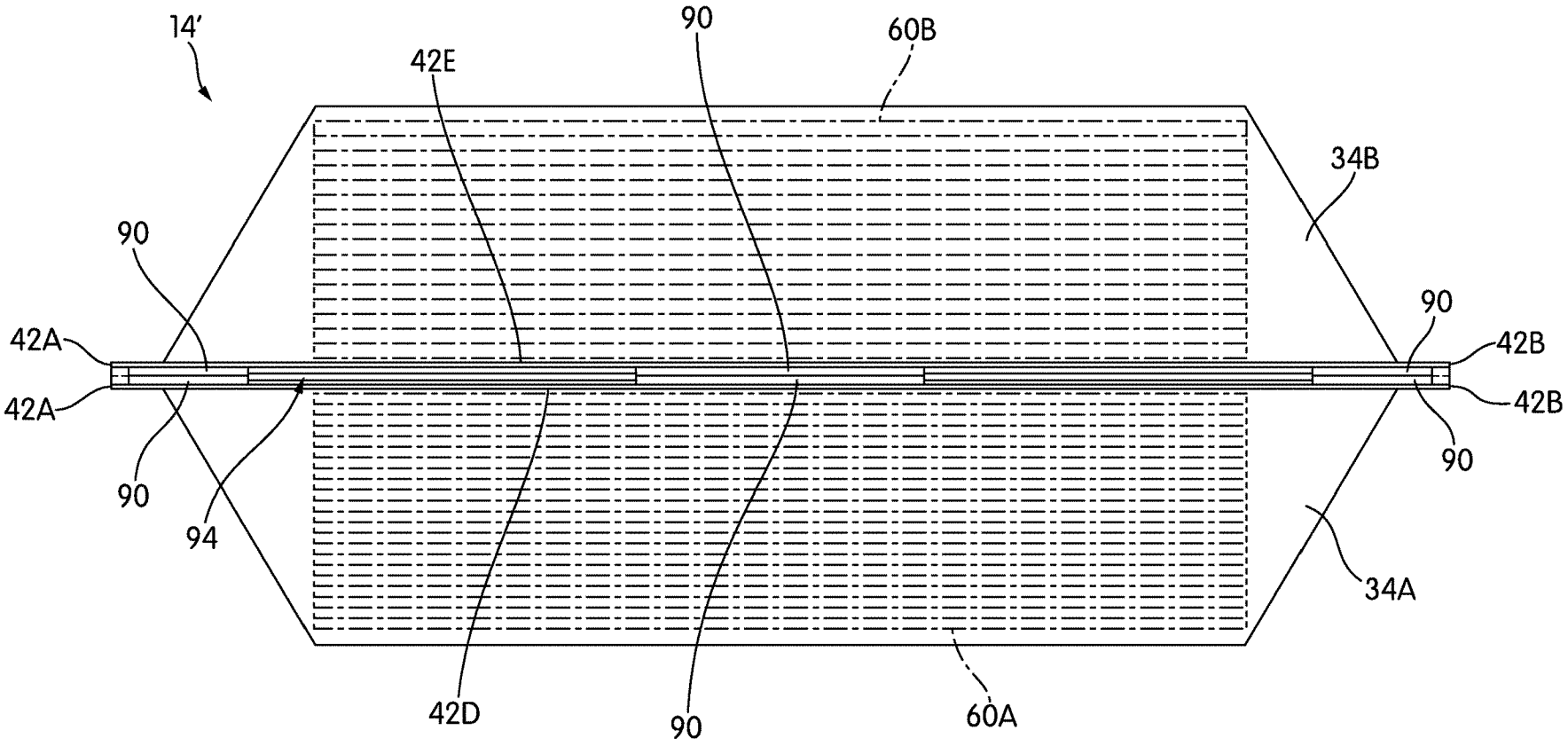
FIG. 7 is a side view of the clamshell package including the rail members of FIG. 5.

The rail members 90 are configured to facilitate air accessibility to each of the receptacles 34A, 34B. Specifically with respect to the clamshell packaging orientation as shown in FIG. 4, the receptacles 34A, 34B are stacked such that the portions 80A, 80B of the lid 18 are adjacent each other, which reduces or inhibits the amount of air that can pass through the lid 18. As such, the required transmission rates of the food products 60A, 60B may not be reached. The separator member (e.g., rail members 90) is configured to separate the stacked receptacles 34A, 34B for facilitating air flow. In the illustrated construction, the rail members 90 are configured to form an air gap 94 (FIGS. 6-7) between the stacked receptacles 34A, 34B when the food container 14' is in the clamshell configuration. As such, the portions 80A, 80B having the different permeability are separated such that air may pass through each portion 80A, 80B appropriately. For example, as illustrated in FIGS. 6 and 7, the receptacle 34A containing the food product 60A (i.e., cheese) is positioned below the receptacle 34B containing the food product 60B (i.e., crackers). The air gap 94 separates the receptacles 34A, 34B such that air may pass through each portion 80A, 80B appropriately using the air gap 94. The illustrated air gap 94 forms an elongated slot broken up by the rail members 90.

Figure 8:
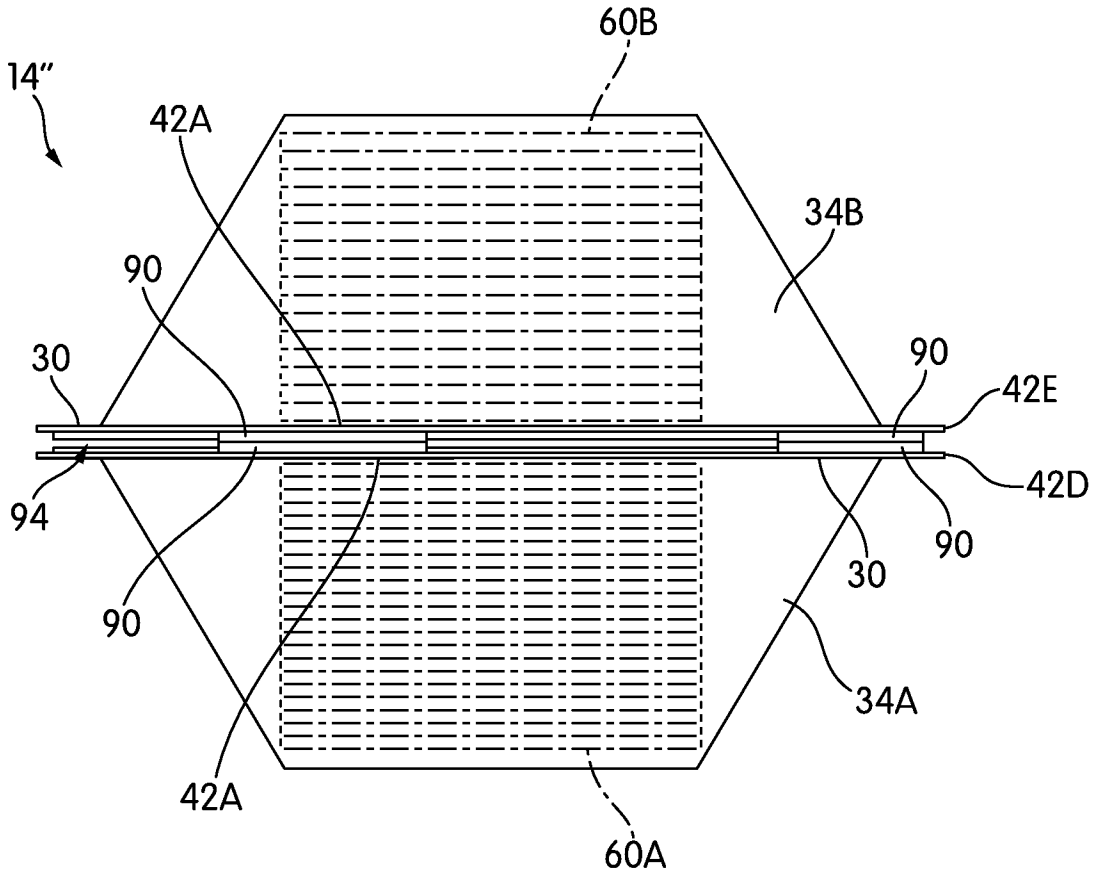
FIG. 8 is a front view of a clamshell package according to another embodiment.

In a third embodiment with particular reference to FIG. 8, the body 10 may be reconfigurable into the food container 14" without the use of the hinge 66. Specifically, body 10 includes separate pieces having the receptacles 34A, 34B. The receptacles 34A, 34B are arranged such that the rim 30 of the first receptacle 34A is parallel to the rim 30 of the second receptacle 34B. As such, the receptacles 34A, 34B are in the stacked relationship (e.g., the second receptacle 34B is positioned above the first receptacle 34A). In addition, the first receptacle 34A may be secured to the second receptacle 34B. The receptacles 34A, 34B may be removably secured by a fastener such as adhesive (e.g., glue, paste, etc.), plastic wrap around the receptacles 34A, 34B, a paperboard sleeve, etc.

Each receptacle 34A, 34B is enclosed by the respective portion 80A, 80B in which each portion 80A, 80B has a different permeability. As discussed above, the illustrated portions 80A, 80B are formed by two separate pieces such that the portion 80A is configured as a first lid and the second portion 80B is configured as a second lid. Once the receptacles 34A, 34B are in the stacked relationship, the first and second lids (i.e., the first and second portions 80A, 80B) are adjacent. Furthermore, in this embodiment, the food container 14" includes the separator member (i.e., the rail members 90) extending from the rim 30. The rail members 90 are positioned between the stacked receptacles 34A, 34B to facilitate the air flow to the portions 80A, 80B having the different permeability. The rail members 90 form the air gap 94 between the stacked receptacles 34A, 34B.

The food container 14 or multiple food containers 14 may further be positioned in secondary packaging (e.g., paperboard sleeve). The secondary packaging may be configured to define an indicia region (not shown) in which logos, images, brands, text, marks, and other indicia can be displayed. The food container(s) 14 may be shipping, stocked on a shelf, etc. using the secondary packaging.

Thus, the disclosure provides, among other things, a convertible food container 14 configured to support multiple product types. The food container 14 facilitates packaging of different products within the same container 14, provides more options of products that can be supported by the same container 14 by providing a lid 18 having different permeability, facilitates packaging in different configurations, and facilitates desired fluid accessibility to the different products 60 within the container 14. Various features and advantages of the invention are set forth in the following claims.

What is claimed is:

1. A food container comprising:

a body including a first and second receptacle;

a first food product contained in the first receptacle;

a second food product contained in the second receptacle, wherein the first and second receptacles are in a stacked relationship relative to one another;

a lid including two peelable portions coupled to the body, a first portion enclosing the first receptacle and a second portion enclosing the second receptacle, each portion providing a barrier completely enclosing its respective receptacle from the environment and having a permeability, the first portion having a permeability different than the second portion and the receptacles being in a stacked relationship relative to one another such that the two peelable portions of the lid are adjacent to one another; and a separator member positioned between the stacked receptacles and forming a gap between the stacked receptacles to enable air to flow in and out of the first and second receptacles only through the first portion and the second portion based up the permeability of the lid.

2. The food container of claim 1, wherein each receptacle is configured to receive its respective food product.

3. The food container of claim 1, wherein the permeability of each portion is determined based on the type of food product contained therein.

4. The food container of claim 1, wherein the lid includes at least two pieces corresponding to the two portions.

5. The food container of claim 1, wherein the lid is flexible.

6. The food container of claim 1, wherein each receptacle has a periphery adjacent the receptacle opening and wherein the lid is sealed to the body near the periphery of each receptacle.

7. The food container of claim 1, wherein the body includes a hinge between the first and second receptacles.

8. The food container of claim 7, wherein a plurality of perforations form the hinge.

9. The food container of claim 7, wherein one receptacle is movable into the stacked relationship with the other receptacle.

10. The food container of claim 6, further including a plurality of separator members positioned along the periphery of at least one of the first and second receptacles.

11. The food container of claim 10, wherein the plurality of separator members are rail members.

12. A food container comprising:

a body including at least two product receptacles containing at least two different food products and a hinge, each receptacle having a periphery;

a peelable lid including at least two pieces coupled to the body, the at least two pieces enclosing the at least two respective receptacles and providing a barrier completely enclosing the receptacles from the environment, each piece having a permeability; and at least one separator member extending upwardly from a periphery of one of the receptacles in a direction opposite to that of the receptacle, wherein one of the pieces has a permeability higher than the others of the pieces, wherein one of the receptacles is movable into a stacked relationship relative to one of the other of the receptacles by way of the hinge such that the at least two pieces are adjacent, and wherein the at least one separator member is configured to separate the stacked receptacles to allow air to flow in and out of both receptacles only through the two pieces subject to the permeability of the pieces.

13. The food container of claim 12, where a first food product is contained in the first receptacle and a second food product is contained in the second receptacle.

14. The food container of claim 12, wherein each receptacle is configured to receive its respective food product.

15. The food container of claim 12, wherein the permeability of each piece is determined based on the type of food product contained therein.

16. The food container of claim 12, wherein the lid is flexible.

17. The food container of claim 12, wherein the lid is sealed to the body near the periphery of each receptacle.

18. The food container of claim 12, wherein a plurality of perforations form the hinge.

19. The food container of claim 12, wherein the at least one separator members includes a plurality of rail members.

20. The food container of claim 19, where the plurality of rail members are spaced around a periphery of at least one of the receptacles.

21. The food container of claim 19, wherein the plurality of rail members are spaced around a periphery of the first and second receptacles.

22. A food container comprising:

a first receptacle containing a first food product and having a periphery;

a first peelable lid completely enclosing the first receptacle from the environment and having a first permeability;

a second receptacle containing a second food product and having a periphery;

a second peelable lid completely enclosing the second receptacle from the environment and having a second permeability; and a plurality of separators positioned on the periphery of the first receptacle extending away from the first receptacle;

wherein the first permeability is different than the second permeability;

wherein the receptacles are stacked so that the first and second lids are adjacent; and wherein the separators facilitate air flow in and out of both receptacles only through the respective first and second peelable lids subject to the permeability of the first and second lids.

23. The food container of claim 22 wherein the first receptacle is secured to the second receptacle.

24. The food container of claim 22, wherein the plurality of separators include a plurality of rail members positioned around the periphery of the first and the second receptacle.

* * * * *